US006684549B2

(12) United States Patent
Bragg

(10) Patent No.: US 6,684,549 B2
(45) Date of Patent: Feb. 3, 2004

(54) RECOIL APPARATUS FOR A FIREARM

(76) Inventor: Elmore J. Bragg, 2415 NE. 153rd Pl., Portland, OR (US) 97230

( * ) Notice: Subject to any disclaimer, the term of this patent is extended or adjusted under 35 U.S.C. 154(b) by 0 days.

(21) Appl. No.: 10/080,930

(22) Filed: Feb. 21, 2002

(65) Prior Publication Data

US 2003/0154640 A1 Aug. 21, 2003

(51) Int. Cl.[7] ..... F41C 23/00
(52) U.S. Cl. ..... 42/74
(58) Field of Search ..... 42/75.01, 75.02, 42/74; 188/267

(56) References Cited

U.S. PATENT DOCUMENTS

| | | | | | |
|---|---|---|---|---|---|
| 294,402 | A | * | 3/1884 | Onderdonk | 42/74 |
| 426,916 | A | * | 4/1890 | Cash et al. | 42/40 |
| 524,458 | A | * | 8/1894 | Blake | 42/74 |
| 943,683 | A | * | 12/1909 | Johnson | 42/74 |
| 1,255,566 | A | * | 2/1918 | Pearson | 42/74 |
| 1,305,617 | A | * | 6/1919 | Pearson | 42/74 |
| 1,307,529 | A | * | 6/1919 | Werndl | 42/74 |
| 1,328,700 | A | * | 1/1920 | Wagoner | 42/74 |
| 1,468,354 | A | * | 9/1923 | Caretto | 42/74 |
| 3,023,528 | A | * | 3/1962 | Rouby | 42/84 |
| 3,461,589 | A | * | 8/1969 | Vironda | 42/74 |
| 5,074,189 | A | * | 12/1991 | Kurtz | 89/135 |
| 5,090,525 | A | * | 2/1992 | Ohlin | 188/266.5 |
| 5,502,901 | A | * | 4/1996 | Brown | 36/28 |
| 6,481,143 | B2 | * | 11/2002 | McCarthy | 42/74 |
| 2001/0005946 | A1 | * | 7/2001 | Brown | 36/28 |

FOREIGN PATENT DOCUMENTS

| | | | | |
|---|---|---|---|---|
| SE | WO 98/48235 | * | 10/1998 | F41C/23/06 |

* cited by examiner

*Primary Examiner*—Charles T. Jordan
*Assistant Examiner*—Denise J Buckley
(74) *Attorney, Agent, or Firm*—Klarquist Sparkman, LLP

(57) ABSTRACT

A recoil apparatus is provided for a firearm comprising a base portion and shoulder member coupled to a base portion and movable longitudinally with respect to the base portion upon firing of the firearm. A magnet system disposed in the base portion comprises a first magnet, a second magnet, and a third magnet. The first magnet provides a magnetic attractive force that prevents relative movement between the shoulder member and the base portion when the firearm is being aimed prior to firing. The second and third magnets are positioned in a repelling configuration with each other such that upon firing, the recoil of the firearm is dampened by the repulsive forces produced by the second and third magnets.

43 Claims, 2 Drawing Sheets

FIG. 4
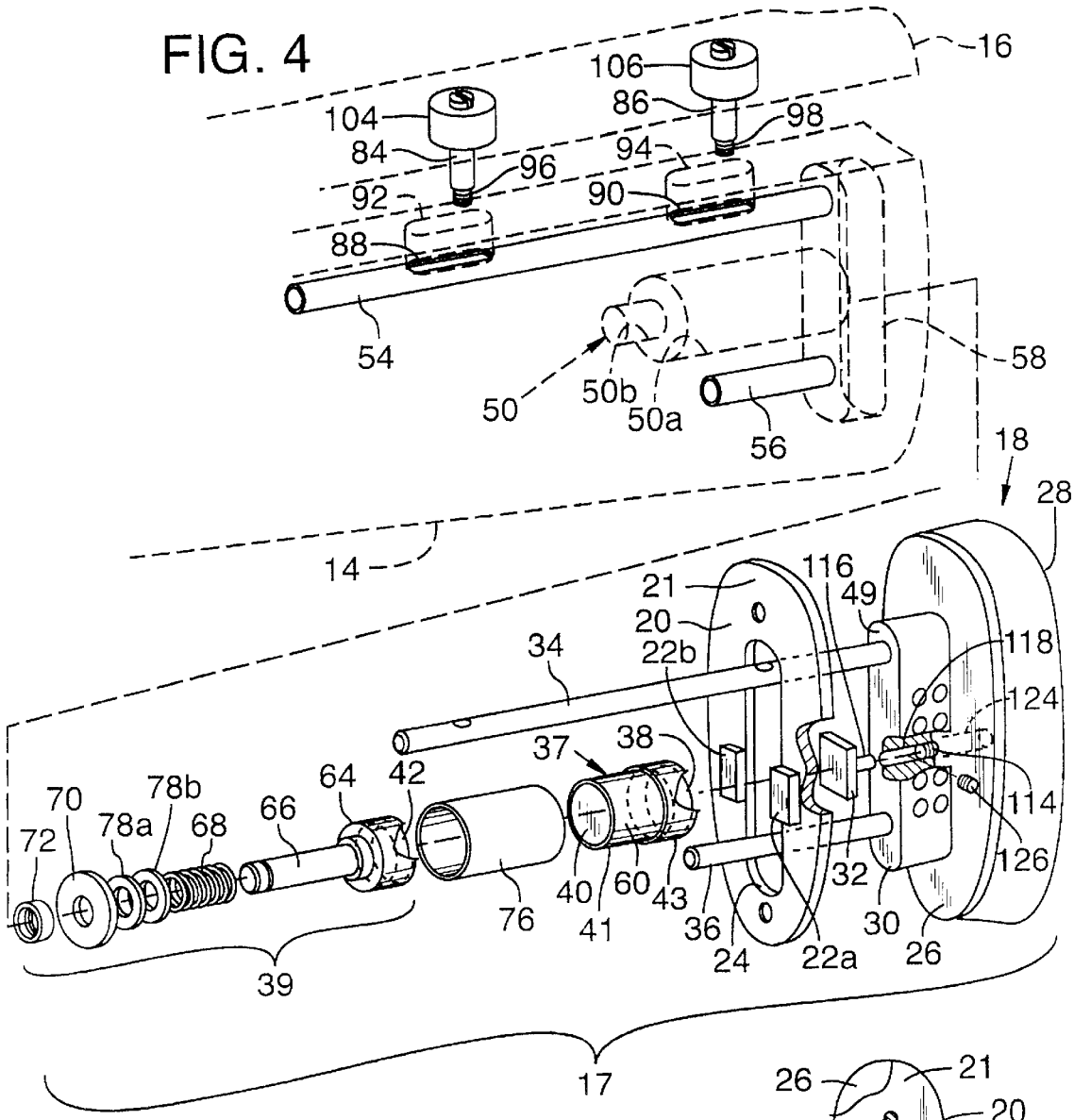
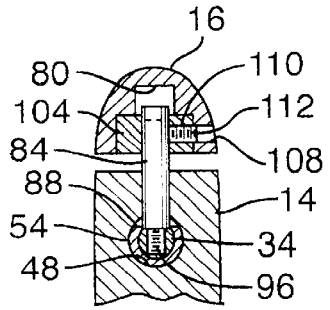
FIG. 6
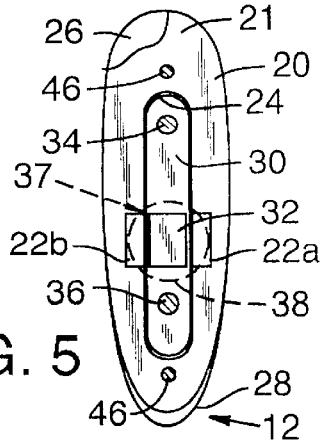
FIG. 5

RECOIL APPARATUS FOR A FIREARM

FIELD

The present invention concerns a device useful to dampen the recoil experienced by a shooter upon firing a firearm.

BACKGROUND

Gun recoil is experienced when using virtually any firearm. Recoil from such firearms can cause the shooter to flinch, the muzzle of the firearm to deflect and for large caliber firearms, discomfort or pain. Such movements generally result in reduced accuracy. Accordingly, it is desirable to reduce recoil to improve accuracy and decrease shooter discomfort.

Recoil devices operable to reduce the amount of recoil transmitted to the shoulder of a shooter are well known in the art. For example, a commonly used recoil system employs one or more compression springs disposed inside the butt stock of a firearm. Upon firing, the butt stock slides rearward toward a shoulder-engaging portion of the firearm, compressing the springs and thereby damping the recoil effect. Other state-of-the-art recoil-reducing devices employ pneumatic air chambers and hydraulic cylinders to reduce the effect of gun recoil.

Despite these prior inventions, there still is a need for recoil damping devices, and methods for their use, that provide for greater reduction in recoil experienced by a shooter.

SUMMARY

The present invention is directed to features and aspects of a recoil reducing apparatus for a firearm, both alone and in various combinations and sub-combinations with one another, which are set forth in the claims below.

According to one representative embodiment, a recoil apparatus for a firearm comprises a magnetic recoil damping system and a housing for housing the system. In particular embodiments, the damping system comprises first and second magnets, which are positioned in a repelling configuration relative to each other. The first and second magnets desirably comprise permanent magnets, although in other embodiments the first and second magnets may comprise electro-magnets. An optional biasing element, such as a compression spring, may be coupled to one of the first and second magnets.

According to another representative embodiment, a recoil apparatus is provided for a firearm comprising a base portion and a shoulder-engaging portion that is movable with respect to the base portion in response to the recoil of the firearm upon firing. First and second magnets, which are desirably disposed in the base portion, are positioned in a repelling configuration relative to each other to produce magnetic repulsion forces that bias the base portion in a direction against the recoil of the firearm. Thus, upon firing of the firearm, the magnetic repulsion forces dampen the recoil energy of the firearm, and therefore reduce the amount of recoil energy that is transmitted from the shoulder-engaging portion to the shoulder of a user.

If desired, a compression spring may be provided to further dampen the recoil of the firearm. In a disclosed embodiment, the spring is axially aligned with and coupled to one of the first and second magnets and is configured to bias the base portion against the recoil of the firearm. Thus, in this manner, the magnetic repulsion forces produced by the first and second magnets in cooperation with the compression spring serve to reduce the amount of recoil energy that is transmitted from the shoulder-engaging portion to the shoulder of a user.

In addition, a third magnet may be disposed in the base portion for producing a magnetic attractive force that restricts the shoulder-engaging portion from moving relative to the base portion when the firearm is being aimed prior to firing. In a specific implementation of the invention, the third magnet is magnetically attracted to an end piece that is coupled to the end of the base portion. The end piece defines an opening that is dimensioned to slidably receive a spacer member of the shoulder-engaging portion upon firing of the firearm. When the firearm is not undergoing recoil, the first magnet is held in front of the opening by way of its magnetic attractive force, to prevent movement of the spacer member through the opening, and therefore prevent movement of the shoulder-engaging portion relative to the base portion.

The end piece may have a pair of magnetic members disposed thereon for magnetically attracting the third magnet. In addition, an adjusting mechanism may be provided for varying the fore-aft position of the third magnet relative to the magnetic members, and therefore the strength of the magnetic attractive force that prevents movement of the shoulder-engaging portion relative to the base portion. Operating the adjustment mechanism to move the third magnet away from the magnetic members decreases the strength of the magnetic attractive force, which in turn decreases the amount of recoil energy that is transmitted to the shoulder of a shooter. Conversely, operating the adjustment mechanism to move the third magnet closer to the magnetic members increases the strength of the magnetic attractive force, which in turn increases the amount of recoil energy that is transmitted to the shoulder of a shooter.

In another representative embodiment, a recoil apparatus for a firearm comprises a first magnet disposed in a base portion of the firearm. The first magnet is configured to produce a magnetic force that retains a shoulder member of the firearm and the base portion from moving relative to each other when the firearm is being aimed prior to firing. Upon firing of the firearm, motion of the shoulder member is arrested by the shoulder of a shooter and the recoil of the base portion overcomes the magnetic force of the first magnet, thereby allowing the base portion to move to the recoil position. In addition, an optional adjustment mechanism may be provided for varying the strength of the magnetic force and therefore the amount of recoil that is transmitted from the shoulder member to the shoulder of the shooter.

According to yet another representative embodiment, a recoil apparatus for a firearm comprises a magnet system disposed in a base portion of the firearm. The magnet system comprises a first magnet, a second magnet, and a third magnet. The first magnet is configured to prevent relative movement between a shoulder member of the firearm and the base portion when the firearm is being aimed prior to firing. The second and third magnets are longitudinally aligned in a repelling configuration to produce repulsion forces that dampen the recoil forces transmitted from the shoulder member to the shoulder of a shooter upon firing of the firearm.

According to still another embodiment, a recoil apparatus is provided for a firearm comprising a base portion and a shoulder member coupled to and movable with respect to the base portion. The recoil apparatus comprises means for magnetically reducing firearm recoil energy that is transmitted from the shoulder member to the shoulder of a user. The recoil apparatus also may include means for magnetically retaining the base portion from moving relative to the shoulder member when the firearm is not undergoing recoil.

These and other features of the invention will be more fully appreciated when the following detailed description of the invention is read in conjunction with the accompanying drawings.

BRIEF DESCRIPTION OF THE DRAWINGS

FIG. 4 is an enlarged exploded perspective view of the recoil assembly and the stock of the firearm of FIGS. 1–3.

FIG. 5 is an enlarged sectional view taken along line 5—5 of FIG. 2 showing the spacer member positioned in the opening of the end piece.

FIG. 6 is a sectional view taken along line 6—6 of FIG. 2.

DETAILED DESCRIPTION

Figure 1:
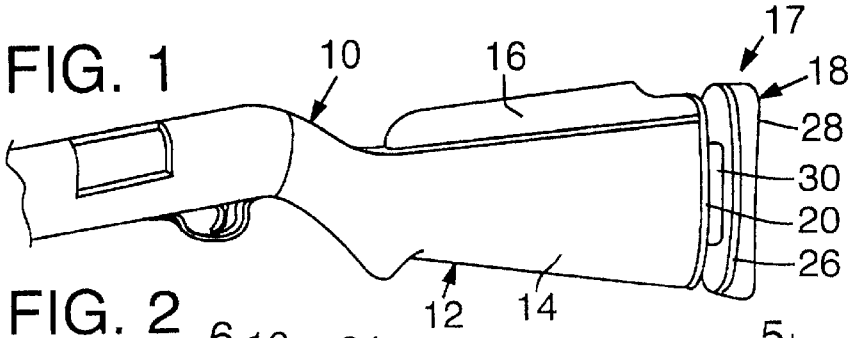
FIG. 1 is a partial perspective view of a firearm having a recoil apparatus constructed in accordance with one embodiment of the invention.

FIG. 1 illustrates a firearm, indicated generally at 10, which may comprise, for example, a shotgun or a rifle. Firearm 10 in the illustrated configuration comprises an elongate stock portion, or butt stock, 12, having a lower base portion 14 and an upper comb portion 16. Base portion 14 is fitted with a recoil apparatus, indicated at 17, constructed in accordance with embodiments of the invention, for absorbing the recoil of the firearm 10.

Referring also to FIGS. 2–5, the recoil apparatus 17 in the illustrated embodiment comprises a shoulder member 18 (also referred to herein as a shoulder-engaging portion in other embodiments), which has a forward mounting plate 26, a butt pad 28 and a spacer member 30 extending forwardly toward the firearm barrel from the mounting plate 26. The spacer member 30 may be secured to the mounting plate 26 as desired, such as by using fasteners, including screws 25 as illustrated. The butt pad 28 desirably comprises a resilient material, such as rubber, as generally known in the art.

A key 32 may be coupled to the forward end of the spacer member 30. The key 32 is positioned to bear against a first magnet 38 (described below) disposed in the base portion 14. The shoulder member 18 is movable longitudinally with respect to the base portion 14 from a first, extended position (FIG. 2) to a second, retracted or recoiled position (FIG. 3) in response to the recoil of the firearm 10 upon firing, as described in greater detail below.

Figure 2:
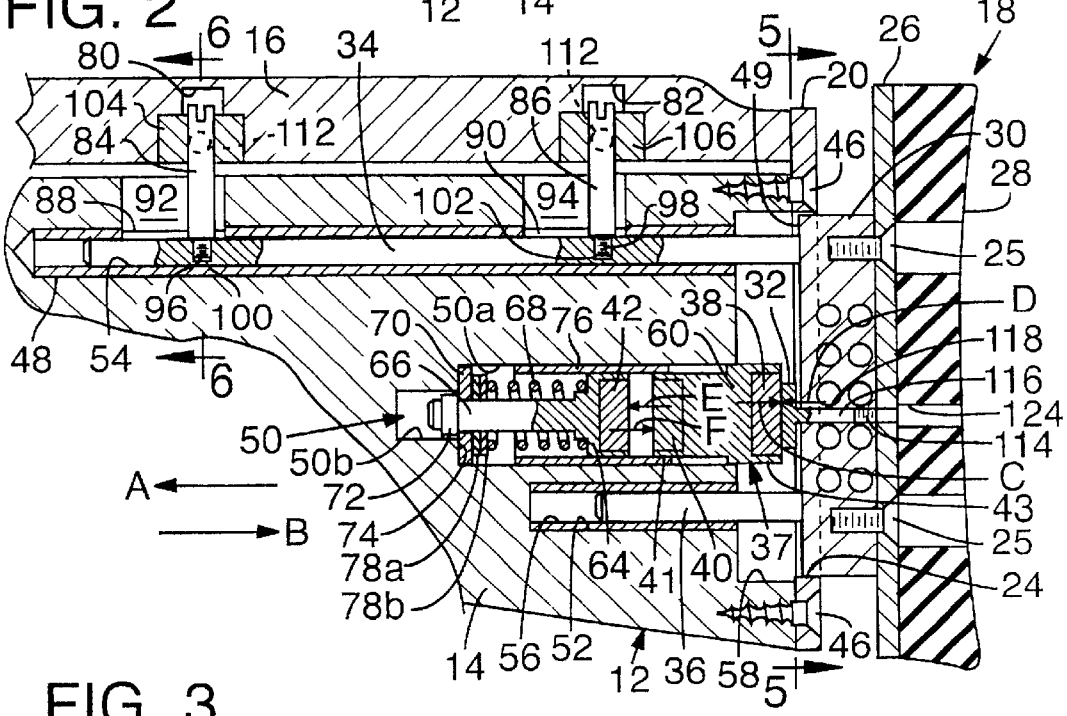
FIG. 2 is an enlarged fragmentary longitudinal vertical section of the butt end of the stock of the firearm of FIG. 1 showing the recoil apparatus prior to firing.
Figure 3:
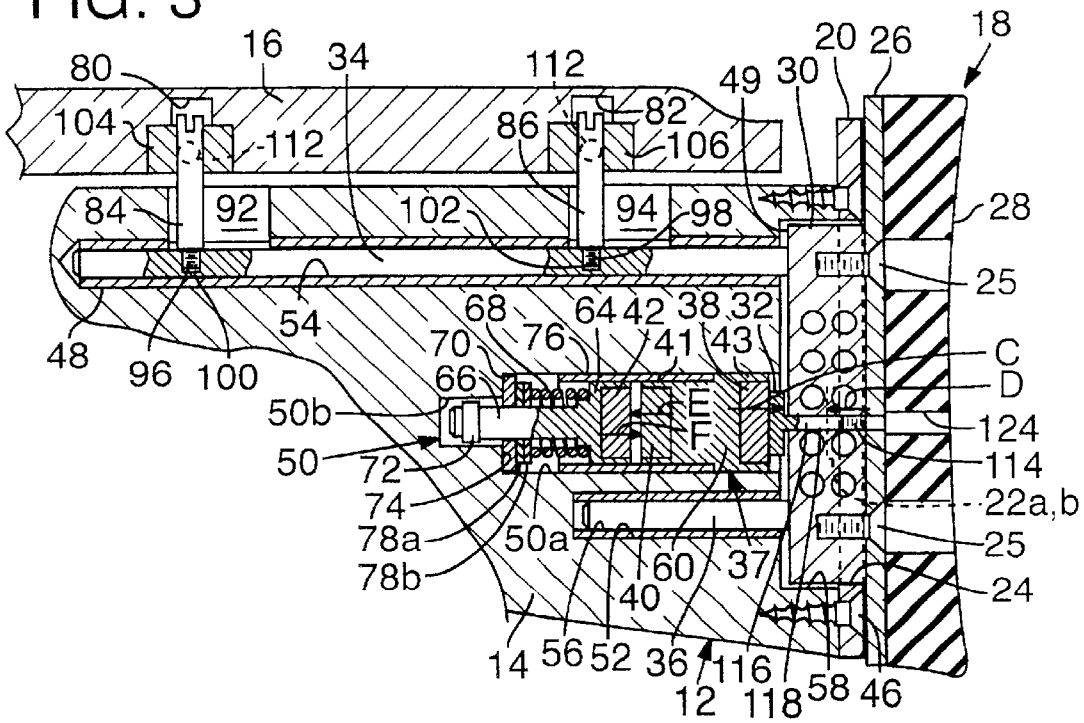
FIG. 3 is a longitudinal vertical section view similar to FIG. 2 showing the recoil apparatus in a recoil position.

As best shown in FIGS. 2 and 3, an end piece, or end plate, 20 is secured to the end of the base portion 14 using any suitable method, such as with fasteners, including the illustrated mounting screws 46. The end piece 20 defines a centrally located opening, or aperture, 24 (as best shown in FIGS. 4 and 5), which is dimensioned to permit passage of the spacer member 30 therethrough. As best shown in FIGS. 2 and 3, the base portion 14 in the illustrated embodiment is formed with a recess 58 and axial, substantially parallel bores 48, 50, and 52, which extend from the recess 58 toward the forward end of the firearm 10. Recess 58 is dimensioned to slidably receive a portion of the spacer member 30. Thus, as shown in FIG. 3, when the shoulder member 18 is moved to its retracted position in response to the recoil of the firearm 10, the spacer member 30 extends through the opening 24 in the end piece 20 and into the recess 58.

In the illustrated embodiment, upper bore 48 extends into the base portion 14 a greater distance than do bores 50 and 52. Upper bore 48 also may be lined with a sleeve 54. The lower bore 52 can be similarly lined with a respective sleeve 56. The sleeves 54, 56 can be made from any suitable material, such as, for example, metals or alloys, including steel or aluminum. The sleeve 54 and the sleeve 56 slidably receive guide rods 34 and 36, respectively, which may be secured to a surface 49 of the spacer member 30. Guide rods 34 and 36, and bores 48, 50, and 52 are substantially parallel to the barrel of the firearm 10. Bore 50 in the illustrated embodiment comprises a stepped cylindrical bore, having a first, larger diameter bore 50*a* and a second, smaller diameter bore 50*b*.

As further shown in FIGS. 2 and 3, a magnet system includes a magnet assembly 37 disposed in the bore 50*a*. Illustrated magnet assembly 37 comprises a cylindrical housing 60, which is formed with recesses in a forward end portion 41 and a rear end portion 43. A first magnet 38 is disposed in the recess formed in the rear end portion 43 of the housing 60. A second magnet 40 is disposed in the recess formed in forward end portion 41 of the housing 60. Other configurations for the magnet assembly 37 and housing 60 also may be used. For example, in an alternative embodiment, first and second magnets 38, 40 may be disposed in separately formed first and second cylindrical housings that are secured to each other in a conventional manner, such as by welding or bolting the housings to each other. In another alternative embodiment, the first magnet 38 and the second magnet 40 may be secured to opposite ends of a shaft without the use of a housing for either magnet.

The second magnet 40 is substantially axially aligned with a third magnet 42, positioned forwardly of the second magnet 40 within the bore 50*a*. The second magnet 40 and the third magnet 42 are positioned in a repelling configuration relative to each other so that the third magnet 42 is urged forwardly (as indicated by arrow E in FIGS. 2 and 3) and the second magnet 40 is urged rearwardly (as indicated by arrow F in FIGS. 2 and 3). An inner sleeve 76, desirably made of a substantially non-magnetic material (e.g., stainless steel), may be disposed in the bore 50*a* to maintain the second and third magnets 40, 42, substantially axially aligned.

Third magnet 42 in the illustrated embodiment is supported in a cylindrical housing 64. A shaft 66 extends from the forward end of the housing 64 and into the smaller diameter bore 50*b*. Secured to the forward end of the shaft 66 within the bore 50*b*, opposite the housing 64, is an end piece 72. A spring-retaining member 70 and elastomeric members in the form of rubber grommets 78*a*, 78*b* are slidably disposed on the shaft 66 proximate the forward end of the bore 50*a*. A biasing element, such as a compression spring 68, is operably positioned in bore 50*a*. The illustrated embodiment includes compression spring 68 concentrically disposed about shaft 66 and extending between the forward end of the housing 64 and the rubber grommets 78*a*, 78*b*. The biasing force of spring 68 urges spring-retaining member 72 forwardly against an adjacent surface 74 of the bore 50*a* and the third magnet 42 rearwardly toward the second magnet 40. Shaft 66 is moveable relative to the spring-retaining member 70 to permit compression and subsequent expansion of spring 68 in response to the firearm recoil.

As best shown in FIGS. 4 and 5, magnetic members 22*a*, 22*b* are mounted to forward surface 21 of end piece 20 for magnetically attracting the first magnet 38. The illustrated embodiment has magnetic members 22*a*, 22*b* on diametrically opposed sides of the opening 24. Magnetic members 22*a*, 22*b* are made of any suitable magnetic material that is attracted to a magnet. For example, the magnetic members 22*a*, 22*b* may be made of steel or any of other various ferromagnetic materials. Alternatively, the end piece 20 also can be made of a suitable magnetic material for magnetically attracting the first magnet 38, in which case the magnetic members 22*a*, 22*b* would not be used.

Under static conditions, that is, when firearm 10 is not recoiling after being filed, the magnetic attractive force produced by the first magnet 38 and the magnetic members 22*a*, 22*b* retains the first magnet 38 in its desired static position, such as in contact with the magnetic members 22*a*, 22*b* (as illustrated in the figures and indicated by arrows C and D in FIGS. 2 and 3). In this position, the first magnet 38 extends across the opening 24 of the end piece 20 (as best shown in FIG. 5) and therefore prevents forward movement of the spacer member 30 relative to the base portion 14 through the opening 24.

The strength of the magnetic attractive force between by the first magnet 38 and the magnetic members 22*a*, 22*b* desirably is sufficient to prevent any relative movement between the shoulder member 18 and the base portion 14 when the firearm 10 is being handled or aimed prior to firing. When firearm 10 is fired, gun recoil forces the base portion 14 in the rearward direction (as indicated by arrow B in FIG. 2) toward the shoulder member 18, which is restrained against movement since it bears against the shooter's shoulder. The energy imparted to the base portion 14 upon firing overcomes the magnetic attractive force between the first magnet 38 and the magnetic members 22*a*, 22*b*, causing key 32 to force the first magnet 38 away from the magnetic members 22*a*, 22*b* and allowing the spacer member 30 to pass through the opening 24 in the end piece 20 and into the recess 58 in the base portion 14. Some recoil energy is dissipated in separating or "breaking" the magnetic attachment of the first magnet 38 and the magnetic members 22*a*, 22*b*.

Second and third magnets 40, 42, respectively, along with the spring 68, serve as recoil reducers for reducing the recoil that is transmitted from the shoulder member 18 to the shoulder of a shooter. More specifically, as illustrated in FIGS. 2 and 3, as the base portion 14 moves rearwardly, the magnet assembly 37 is restrained against rearward movement by the spacer member 30. This causes the magnet assembly 37 to slide forwardly relative to the bore 50*a*, toward the third magnet 42, and against the bias of the magnetic repulsion forces produced by the second and third magnets 40, 42 and, if a second recoil reduction device is included, such as spring 68, against the biasing force of the spring 68 (FIG. 3). As the second magnet 40 is moved toward the third magnet 42, the third magnet 42 is driven forwardly relative to the bores 50*a* and 50*b*, thereby compressing the spring 68. In this manner, recoil energy is absorbed by compression of the spring 68 and by the repulsive forces produced by the second and third magnets 40, 42, as the base portion 14 moves toward the shoulder member 18. The strength of the second and third magnets 40, 42 are selected so that when the base portion 14 reaches the fully recoiled position, as shown in FIG. 3, there remains a slight separation between the second and third magnets 40, 42, respectively.

For working embodiments, each of the first, second and third magnets 38, 40 and 42 have a magnetic holding force of about 58 lbs. to about 115 lbs., with about 100 lbs. being a specific example, although magnets with greater or lesser holding forces also may be used. Suitable magnets are commercially available from, for example, Bunting Magnetics Co. of Newton, Kans. under Product Nos. BM2105RE, BM2106RE and BM2107RE.

Upon firing of the firearm 10, the shooter experiences some recoil as the energy of the base portion 14 overcomes the magnetic attractive force between the first magnet 38 and the magnetic members 22*a*, 22*b* and begins to move rearwardly toward the shoulder member 18. Consequently, recoil transmitted to the shoulder of the shooter as a result of the initial movement of the base portion 14 depends, in part, on the strength of the magnetic attractive force between the first magnet 38 and the magnetic members 22*a*, 22*b*. Thus, to enable a shooter to easily adjust the amount of recoil transmitted to his or her shoulder, an adjustment mechanism may be provided for varying the position of the first magnet 38 fore and aft relative to the magnetic members 22*a*, 22*b*, and therefore the strength of the magnetic attractive force between the first magnet 38 and the magnetic members 22*a*, 22*b*.

As best shown in FIG. 4, an adjustment mechanism according to one embodiment comprises a post 116 that extends from the rear surface of the key 32 and into the forward end of a bore 118 formed in the spacer member 30. The opposite end of the bore 118 is threaded to receive a cooperatively threaded adjusting screw 114, which bears against the end of the post 116. In the illustrated embodiment, access to the adjusting screw 114 is provided through an opening 124 formed in the butt pad 28 and the mounting plate 26 (FIGS. 2–4). Otherwise, screws 25 are readily removed to detach the butt pad 28 and the mounting plate 26 from the spacer member 30 to gain access to the adjusting screw 114. Spacer member 30 may be provided with a transversely extending, threaded opening in one side thereof for receiving a threaded set screw 126 (FIG. 4), which when tightened, bears against the side of the post 116 to secure the key 32 against movement once the position of the adjusting screw 114 is set.

When the first magnet 38 is in contact with the magnetic members 22*a*, 22*b* (as shown in FIG. 2), the magnetic attractive force between the first magnet 38 and the magnetic members 22*a*, 22*b*, and therefore the holding force that prevents relative movement between the shoulder member 18 and the base portion 14, is greatest. However, adjusting the screw 114 in the forward direction (in the direction of arrow A) along the length of the bore 118, causes the key 32 to drive the first magnet 38 away from the magnetic members 22*a*, 22*b*, which causes a corresponding decrease in the magnetic attractive force between the first magnet 38 and the magnetic members 22*a*, 22*b*. Because the strength of the magnetic attractive force is decreased, less recoil is transmitted from the shoulder member 18 to the shoulder of the shooter upon firing the firearm 10. The first magnet 38 can be moved back toward the magnetic members 22*a*, 22*b* by adjusting the screw 114 in the rearward direction (in the direction of arrow B), which allows the first magnet 38 to move toward the magnetic members 22*a*, 22*b* under the biasing force of the spring 68 and the repulsion force of the second and third magnets 40, 42, respectively.

Other forms of an adjusting mechanism for adjusting the magnetic force between first magnet 38 and magnetic members 22*a*, 22*b* also may be used. For example, in an alternative embodiment, adjusting screw 120 extends through the spacer member 30 and directly contacts the rear surface of the first magnet 38. Thus, in this configuration, key 32 is not used.

In alternative embodiments, the strength of the magnetic attractive force between the first magnet 38 and the magnetic members 22*a*, 22*b* can be varied, for example, by selecting a first magnet 38 with greater or lesser magnetic strength, by varying the size of the magnetic members 22*a*, 22*b* and/or by selecting magnetic members 22*a*, 22*b* with higher or lower iron content.

Other configurations of a recoil apparatus may embody one or more features of the embodiment shown in FIGS. 1–6. For example, in one alternative embodiment, a magnet system comprises only two magnets. A first magnet is operable to prevent relative movement of the shoulder member 18 in a static mode in the same manner as the first magnet 38 of FIGS. 2–5. The first magnet is longitudinally aligned in a repelling configuration with a second magnet, which may be coupled to a biasing mechanism (e.g., a spring), such as shown in FIGS. 2–4. Thus, in this embodiment, the first magnet performs the function of both the first magnet 38 and the second magnet 40 of the embodiment shown in FIGS. 2–4, and the second magnet performs the function of the third magnet 42 of FIGS. 2–4.

In another embodiment, a magnet system comprises a pair of magnets arranged in a repelling configuration, such as the second and third magnets 40, 42, respectively, of FIGS. 2–4, to dampen the recoil of the firearm. In this configuration, the spring 68 and the first magnet 38 of the embodiment of FIGS. 2–4 can be optional. Desirably, the two magnets of the magnet system in this configuration are selected to produce repulsion forces that are sufficient to prevent relative movement between the shoulder member 18 and the base portion 14 when the firearm 10 is being aimed prior to firing and to adequately adsorb recoil energy upon firing without the use of a spring.

In still other embodiments, the first magnet 38 of FIGS. 2–5 may be used to prevent relative movement of the shoulder member 18 when the firearm is recoiling after being fired, as shown and described herein, but the second and third magnets 40, 42, respectively, of FIGS. 2–4 may be optional. In this configuration, a conventional recoil reducer (e.g., one or more compression spring(s), hydraulic cylinder (s), or a pneumatic air chamber) may be used in lieu of the spring 68 and the second and third magnets 40, 42, respectively, of the embodiment of FIGS. 2–4.

Moreover, although the first, second and third magnets 38, 40 and 42 of the illustrated embodiment are shown as being permanent magnets, this is not a requirement. For example, in alternative embodiments one or more of the first, second and third magnets 38, 40 and 42 may comprise an electromagnet.

The upper comb portion 16 and the manner in which it is coupled to the base portion 14 may be conventional. Referring again to FIGS. 2 and 3, for example, upwardly extending, first and second dowel pins 84 and 86, respectively, are secured to the upper guide rod 34. The first and second pins 84 and 86, respectively, include lower threaded portions 96 and 98, respectively, which are threadedly received in respective threaded bores 100 and 102 provided in upper guide rod 34. The first and second dowel pins 84, 86, respectively, extend upwardly through slots 88 and 90, respectively, in the sleeve 54 and bores 92 and 94, respectively, in the upper portion of the base portion 14 and into the upper comb portion 16. The upper portions of the pins 84 and 86 are configured to receive the blade of a screwdriver (e.g., a flathead or Philips screwdriver) so that the pins 84 and 86 can be tightened into their respective bores 100, 102 of the upper guide rod 34.

The comb portion 16 is provided with first and second stepped bores 80 and 82, respectively, in which are fixedly received first and second sleeves 104 and 106, respectively, for slidably receiving the pins 84 and 86, respectively. Sleeves 104 and 106 may be securely positioned by suitable methods, such as by being glued into their respective bores 80 and 82 with a suitable adhesive, such as epoxy resin.

Referring to FIG. 6, the upper comb portion 16 also includes horizontally extending bores 108, which extend from the outer side surface of the comb portion 16 to each of the sleeves 104 and 106. Each sleeve 104, 106 is provided with a threaded opening 110 for receiving a cooperatively threaded set screw 112. Set screws 112 can bear against pins 84 and 86 to secure them against vertical movement within the comb portion 16. Thus, the height of the comb portion 16 relative to the base portion 14 can be adjusted by loosening the set screws 112, raising or lowering the comb portion 16 to the desired position, and thereafter tightening the set screws 112.

Comb portion 16 is operable to isolate a user's cheek from the recoil of the firearm upon firing, as generally known in the art. In the illustrated embodiment, for example, comb portion 16 remains in a fixed position and does not slide relative to the user's cheek since it is fixed relative to the shoulder member 18. Accordingly, the user's cheek, resting against the comb portion 16, is not subjected to the recoil movement of the firearm 10.

The foregoing description provides one specific configuration for a comb portion 16 and a mechanism for coupling the comb portion 16 to the base portion 14. Other configurations for the comb portion 16 or mechanisms for coupling the comb portion 16 to the base portion 14 also may be used without departing from the principles and scope of the invention. In other alternative embodiments, the comb portion 16 may be optional.

Recoil apparatus 17 can be easily installed in a new firearm during the manufacturing process or retrofitted in an existing unit. In one approach, for example, bores 48, 50 and 50 and recess 58 are formed in the base portion 14 of a firearm in a conventional manner. The components of recoil apparatus 17 are then installed in the firearm as shown in the figures.

The invention has been described with respect to particular embodiments and modes of action for illustrative purposes only. The present invention may be subject to many modifications and changes without departing from the spirit or essential characteristics thereof. I therefore claim as my invention all such modifications as come within the scope of the following claims.

I claim:

1. A recoil apparatus for a firearm having a butt stock, the recoil apparatus comprising, a magnetic recoil damping system and a housing comprising a portion of the butt stock for housing the system, the system producing a magnetic repulsion force that reduces firearm recoil energy.

2. The recoil apparatus of claim 1, wherein the damping system comprises a first magnet and a second magnet, the first and second magnets being positioned in a repelling configuration relative to each other.

3. The recoil apparatus of claim 2, wherein the first and second magnets comprise permanent magnets.

4. The recoil apparatus of claim 2, further comprising a biasing element coupled to one of the first and second magnets.

5. A recoil apparatus for a firearm having a base portion and a shoulder-engaging portion that is movable with respect to the base portion in response to the recoil of the firearm upon firing, the recoil apparatus comprising:

a first magnet; and a second magnet positioned in a repelling configuration relative to the first magnet such that repulsion forces produced by the first and second magnets reduce firearm recoil energy by damping movement of the base portion relative to the shoulder engaging portion.

6. The recoil apparatus of claim 5, wherein the first and/or second magnets are disposed in the base portion.

7. The recoil apparatus of claim 5, wherein repulsion forces produced by the first and second magnets substantially prevent relative movement between the shoulder-engaging portion and the base portion prior to firing.

8. The recoil apparatus of claim 5, further comprising a compression spring disposed in the base and coupled to one of the first and second magnets.

9. The recoil apparatus of claim 8, wherein the spring exerts a biasing force against the recoil of the firearm to further reduce firearm recoil energy.

10. The recoil apparatus of claim 8, wherein the spring is substantially axially aligned with the first and second magnets.

11. The recoil apparatus of claim 5, further comprising a third magnet that produces a magnetic attractive force that restricts the shoulder-engaging portion from moving relative to the base portion prior to firing.

12. The recoil apparatus of claim 11, wherein the third magnet is disposed in the base.

13. The recoil apparatus of claim 11, further comprising a spacer member coupled to the shoulder-engaging portion and an end piece coupled to the base portion, the end piece defining an opening dimensioned to receive the spacer member upon firing of the firearm, the third magnet being magnetically attracted to the end piece, the third magnet and the end piece being positioned relative to each other at a distance selected to prevent the shoulder-engaging portion from urging the spacer member through the opening, and therefore prevent movement of the shoulder-engaging portion relative to the base portion when the firearm is being aimed prior to firing.

14. A recoil apparatus for the butt stock of a firearm, the butt stock having a having a base portion, the recoil apparatus comprising:

a shoulder member coupled to the base portion, the shoulder member and base portion being movable with respect to the each other between a pre-firing position and a recoil position; and a first magnet disposed in the base portion and producing a magnetic force that retains the shoulder member and the base portion in the pre-firing position prior to firing and whereby when the firearm is fired, motion of the shoulder member is arrested by the shoulder of a shooter and recoil of the base portion exceeds the magnetic force of the first magnet, thereby allowing the base portion to move to the recoil position.

15. The recoil apparatus of claim 14, the base portion having an end piece that defines an opening, and wherein at least a portion of the shoulder member is movable through the opening upon firing of the firearm, at least a portion of the first magnet being magnetically attracted to the end piece and positioned to substantially prevent movement of the shoulder member through the opening when the firearm is being aimed prior to firing.

16. The recoil apparatus of claim 15, wherein the end piece includes at least one magnetic member for magnetically attracting the first magnet.

17. The recoil apparatus of claim 16, further comprising plural magnetic members disposed about the opening of the end piece.

18. The recoil apparatus of claim 14, further comprising an adjustment mechanism for adjusting the strength of the magnetic force that retains the shoulder member and the base portion in the pre-firing position when the firearm is being aimed prior to firing.

19. The recoil apparatus of claim 18, wherein the strength of the magnetic force is adjusted by adjusting a spacing distance between the first magnet and a magnetic member coupled to the base portion.

20. The recoil apparatus of claim 14, further comprising a second magnet positioned to repel the first magnet, the first and second magnets producing repulsion forces that repel the first and second magnets away from each other against the recoil of the firearm.

21. The recoil apparatus of claim 20, further comprising a biasing element that urges the second magnet toward the first magnet.

22. The recoil apparatus of claim 21, wherein the biasing element comprises a spring that is coupled to the second magnet.

23. The recoil apparatus of claim 14, further comprising a recoil reducer disposed in the base portion and configured to absorb firearm recoil.

24. The recoil apparatus of claim 23, wherein the recoil reducer comprises a magnet system.

25. The recoil apparatus of claim 24, wherein the magnet system comprises a second magnet and a third magnet disposed in the base portion and arranged in a repelling configuration, and whereby when the base portion moves toward the shoulder member upon firing of the firearm, the second and third magnets are caused to move toward each other, thereby increasing the magnetic repulsion force between the second and third magnets.

26. A recoil apparatus for a firearm comprising a base portion with a shoulder member coupled thereto and being movable longitudinally with respect to the base portion between an extended position and a retracted position, the recoil apparatus comprising:

an end piece coupled to the base portion, the end piece defining an opening that is dimensioned to receive at least a portion of the shoulder member when the shoulder member is moved to its refracted position; and a magnet disposed in the base portion in attracting relationship with the end piece, the magnet producing a magnetic attractive force that holds the magnet at a position that prevents the shoulder member from moving through the opening to the retracted position when the firearm is not undergoing recoil;

whereby when the firearm is fired, gun recoil overcomes the magnetic attractive force to allow the shoulder member to move through the opening to its refracted position.

27. The recoil apparatus of claim 26, further comprising a magnet assembly disposed in the base portion, the magnet assembly comprising at least a first magnet and a second magnet substantially longitudinally aligned in a magnetically repelling configuration, whereby magnetic repulsion forces produced by the first and second magnets dampen firearm recoil.

28. The recoil apparatus of claim 26, further comprising a spring dispose in the base portion to oppose movement of the shoulder member relative to the base.

29. The recoil apparatus of claim 26, further comprising at least one magnetic member on the end piece for magnetically attracting the magnet.

30. The recoil apparatus of claim 29, comprising plural magnetic members on the end piece for magnetically attracting the magnet.

31. The recoil apparatus of claim 26, further comprising a magnet-position adjuster operable to adjust the position of the magnet relative to the end piece to vary the strength of the magnetic attractive force at the end piece.

32. The recoil apparatus of claim 31, wherein the magnet-position adjuster comprises an adjusting screw operatively coupled to the first magnet such that adjusting the position of the screw causes the first magnet to move relative to the end piece.

33. A recoil apparatus for a firearm comprising a base portion and a shoulder member coupled to the base portion, the shoulder member and base portion being movable longitudinally with respect to the each other upon firing of the firearm, the recoil apparatus comprising:

a magnet system disposed in the base portion, the magnet system comprising a first magnet, a second magnet, and a third magnet, the first magnet being configured to prevent relative movement between the shoulder member and the base portion prior to firing, and the second and third magnets being substantially longitudinally aligned in a repelling configuration, whereby repulsion forces of the second and third magnets dampen firearm recoil.

34. The recoil apparatus of claim 33, wherein the base portion defines a longitudinally extending bore, and wherein the first magnet, the second magnet, and the third magnet are substantially aligned longitudinally in the bore.

35. The recoil apparatus of claim 34, further comprising a biasing mechanism disposed in the bore and coupled to one of the second and third magnets to further dampen firearm recoil.

36. The recoil apparatus of claim 33, wherein the base portion has an end piece defining an opening, at least a portion of the shoulder member being movable through the opening upon firing of the firearm, and wherein the first magnet is magnetically attracted to the end piece and is positioned at a location selected to substantially prevent movement of the shoulder member through the opening prior to firing.

37. A recoil apparatus for a firearm, the firearm having an elongate stock comprising a base portion and a shoulder member being movable relative to the base portion, the recoil apparatus comprising means for magnetically reducing firearm recoil energy by damping movement of the base portion relative to the shoulder member.

38. The recoil apparatus of claim 37, further comprising means for magnetically substantially restricting the base portion from moving relative to the shoulder member when the firearm is not undergoing recoil.

39. The recoil apparatus of claim 37, wherein the means for magnetically reducing firearm recoil comprises plural magnets aligned in a repelling configuration to produce magnetic repulsion forces that bias the base portion against the firearm recoil.

40. A method for making or retrofitting a firearm, the method comprising:

providing a firearm having a base portion and a shoulder portion being moveable relative to the base portion; and installing a magnetic recoil damping system in the firearm, the damping system configured to dampen movement of the base portion relative to the shoulder portion upon firing of the firearm.

41. The method of claim 40, further comprising forming a substantially longitudinally extending bore in the base portion of the firearm and installing the magnetic recoil damping system in the bore.

42. The method of claim 41, wherein installing the magnetic recoil damping system in the bore comprises positioning two magnets in the bore in a repelling configuration relative to each other.

43. The method of claim 42, further comprising installing a biasing element in the bore.

* * * * *